US011282635B2

(12) United States Patent
Ichimura et al.

(10) Patent No.: US 11,282,635 B2
(45) Date of Patent: Mar. 22, 2022

(54) STATIONARY INDUCTION ELECTRIC APPARATUS

(71) Applicant: Hitachi, Ltd., Tokyo (JP)

(72) Inventors: Satoshi Ichimura, Tokyo (JP); Daigo Komesu, Tokyo (JP); Shinji Fujita, Tokyo (JP); Hiroshi Morita, Tokyo (JP); Li Lu, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 191 days.

(21) Appl. No.: 16/638,005

(22) PCT Filed: May 15, 2018

(86) PCT No.: PCT/JP2018/018660
§ 371 (c)(1),
(2) Date: Feb. 10, 2020

(87) PCT Pub. No.: WO2019/044050
PCT Pub. Date: Mar. 7, 2019

(65) Prior Publication Data

US 2020/0219646 A1 Jul. 9, 2020

(30) Foreign Application Priority Data

Aug. 29, 2017 (JP) ..... JP2017-163990

(51) Int. Cl.
*H01F 27/36* (2006.01)
*H01F 27/28* (2006.01)
*H01F 27/32* (2006.01)

(52) U.S. Cl.
CPC ..... *H01F 27/2885* (2013.01); *H01F 27/324* (2013.01); *H01F 27/36* (2013.01)

(58) Field of Classification Search
CPC .... H01F 27/2885; H01F 27/36; H01F 27/324; H01F 27/363; H01F 30/12
See application file for complete search history.

(56) References Cited

U.S. PATENT DOCUMENTS 4,089,049 A * 5/1978 Suzuki ..... H01F 27/36 307/91
4,176,334 A * 11/1979 Buritz ..... H01F 27/362 336/84 C (Continued)

FOREIGN PATENT DOCUMENTS

JP 56165308 A * 12/1981 ..... H01F 27/36
JP 60-226112 A 11/1985

(Continued)

OTHER PUBLICATIONS

International Search Report (PCT/ISA/210) issued in PCT Application No. PCT/JP2018/018660 dated Aug. 21, 2018 with English translation (three (3) pages).

(Continued)

*Primary Examiner* — Tuyen T Nguyen
(74) *Attorney, Agent, or Firm* — Crowell & Moring LLP

(57) ABSTRACT

An object of the present invention is to provide a stationary induction electric apparatus that can improve insulating performance with a few additional structures. In the stationary induction electric apparatus comprising: an iron core 1; a low-voltage coil conductor 400 wound on the iron core; an insulator 3 enclosing the low-voltage coil conductor; and a high-voltage coil conductor 2 which is wound on the insulator and to which a voltage is applied from the outside, a first shield conductor 5 wound adjacent to the inner peripheral surface of the insulator, a second shield conductor 4 wound adjacent to the outer peripheral surface of the insulator, one end of the first shield conductor, and one end of the second shield conductor are electrically connected to any region of the high-voltage coil conductor.

7 Claims, 11 Drawing Sheets

(56) References Cited

U.S. PATENT DOCUMENTS

| | | | | |
|---|---|---|---|---|
| 4,518,941 | A * | 5/1985 | Harada | H01F 19/08 336/69 |
| 5,150,046 | A * | 9/1992 | Lim | H01F 27/36 323/356 |
| 2002/0167822 | A1 | 11/2002 | Odell et al. | |

FOREIGN PATENT DOCUMENTS

| | | | |
|---|---|---|---|
| JP | 63-211710 | A | 9/1988 |
| JP | 2001-93749 | A | 4/2001 |
| JP | 2002-164227 | A | 6/2002 |
| JP | 2002-280242 | A | 9/2002 |

OTHER PUBLICATIONS

Japanese-language Written Opinion (PCT/ISA/237) issued in PCT Application No. PCT/JP2018/018660 dated Aug. 21, 2018 (three (3) pages).

* cited by examiner

B-B CROSS SECTION

A-A CROSS SECTION

B'-B' CROSS SECTION

A'-A' CROSS SECTION

STATIONARY INDUCTION ELECTRIC APPARATUS

TECHNICAL FIELD

The present invention relates to a stationary induction electric apparatus, and particularly to a stationary induction electric apparatus suitable for being downsized by improving insulating performance.

BACKGROUND ART

The size of a transformer for electric power is largely governed by the dimension of insulation (referred to as primary insulation) between a low-voltage coil and a high-voltage coil. In the case of an oil-filled transformer, the primary insulation has a repeat structure of insulating oil and press boards that are solid insulators in many cases. In addition, when a voltage is applied between the low-voltage coil and the high-voltage coil, an inner electric field becomes high because the insulating oil is smaller in permittivity than the press boards. On the other hand, since the insulating oil is smaller in insulating resistance (allowable electric field) than the press boards, the part of the insulating oil becomes a weak point in the primary insulation, and governs the whole necessary dimension.

In relation to the above, Japanese Unexamined Patent Application Publication No. 2001-93749 (Patent Literature 1) describes the following. Shield electrodes are arranged near respective electrodes between the electrodes opposed to each other at intervals where a fluid insulator flows, the shield electrodes and the electrodes near the shield electrodes are connected to each other through potential lines, a high electric field strength part is generated in a solid insulator having high insulation breakdown strength by filling a space between the shield electrodes opposed to each other with the solid insulator, and thus an insulation dimension between the electrodes can be made smaller.

CITATION LIST

Patent Literature

Patent Literature 1: Japanese Unexamined Patent Application Publication No. 2001-93749

SUMMARY OF INVENTION

Technical Problem

However, in the case where the means described in Patent Literature 1 is applied to the primary insulation between the low-voltage coil and the high-voltage coil, it is necessary to arrange the shield electrodes not only between the low-voltage coil and the high-voltage coil, but also between iron cores adjacent to upper and lower ends of the coils and the coils, and the number of additional structures is disadvantageously increased.

Accordingly, an object of the present invention is to provide a stationary induction electric apparatus that can improve insulating performance with a few additional structures.

Solution to Problem

In order to achieve the above-described object, the present invention provides a stationary induction electric apparatus comprising: an iron core; an insulator enclosing the iron core; and a coil conductor which is wound on the insulator and to which a voltage is applied from the outside, wherein a shield conductor is wound adjacent to the inner peripheral surface or the outer peripheral surface of the insulator, and one end of the shield conductor is electrically connected to any region of the coil conductor.

Advantageous Effects of Invention

According to the present invention, it is possible to provide a stationary induction electric apparatus that can improve insulating performance with a few additional structures.

DESCRIPTION OF EMBODIMENTS

Hereinafter, preferred embodiments of a stationary induction electric apparatus of the present invention will be described in detail using the drawings. It should be noted that constitutional elements having the same functions will be followed by the same signs in all the drawings for explaining the embodiments of the invention, and the repeated explanation thereof will be omitted.

First Embodiment

A first embodiment will be described using FIG. 1 to FIG. 4, FIG. 9, FIG. 10, and FIG. 12 to FIG. 14.

Figure 9:
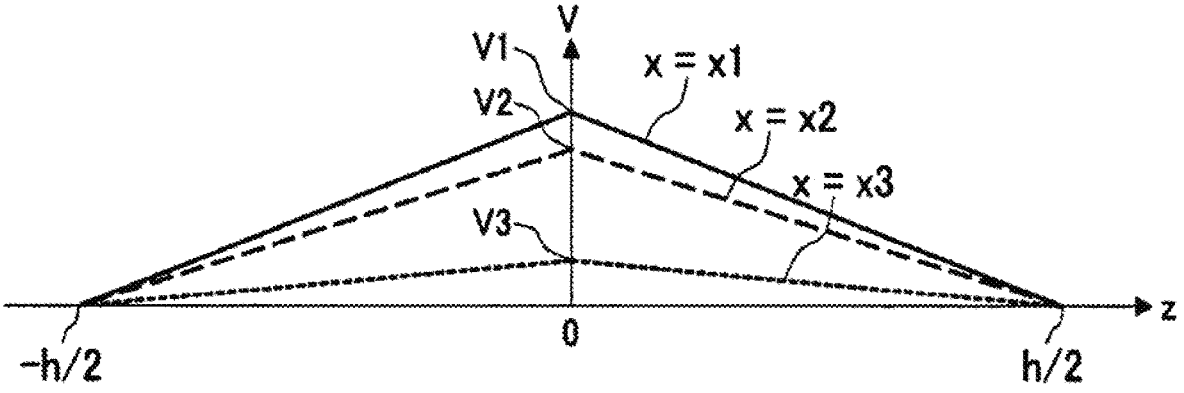
FIG. 9 is a potential distribution diagram in the vertical direction in the first embodiment.
Figure 10:
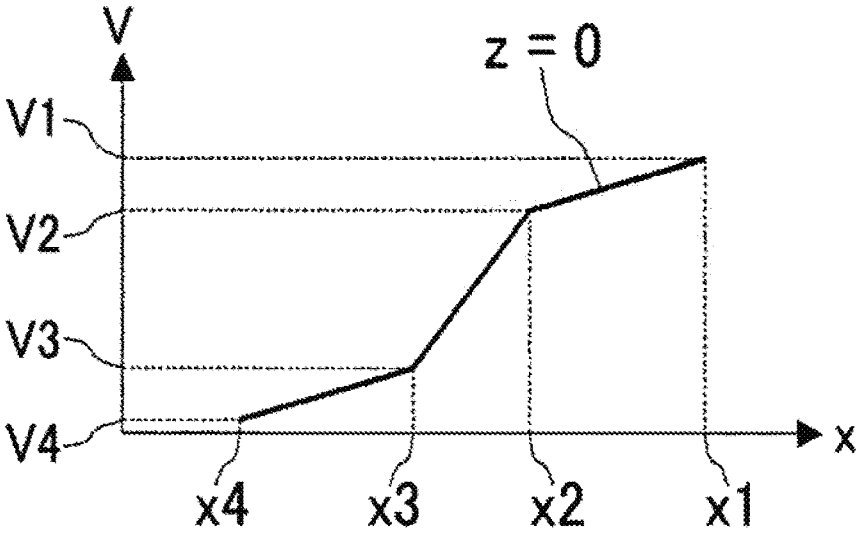
FIG. 10 is a potential distribution diagram in the radial direction in the first embodiment.
Figure 12:
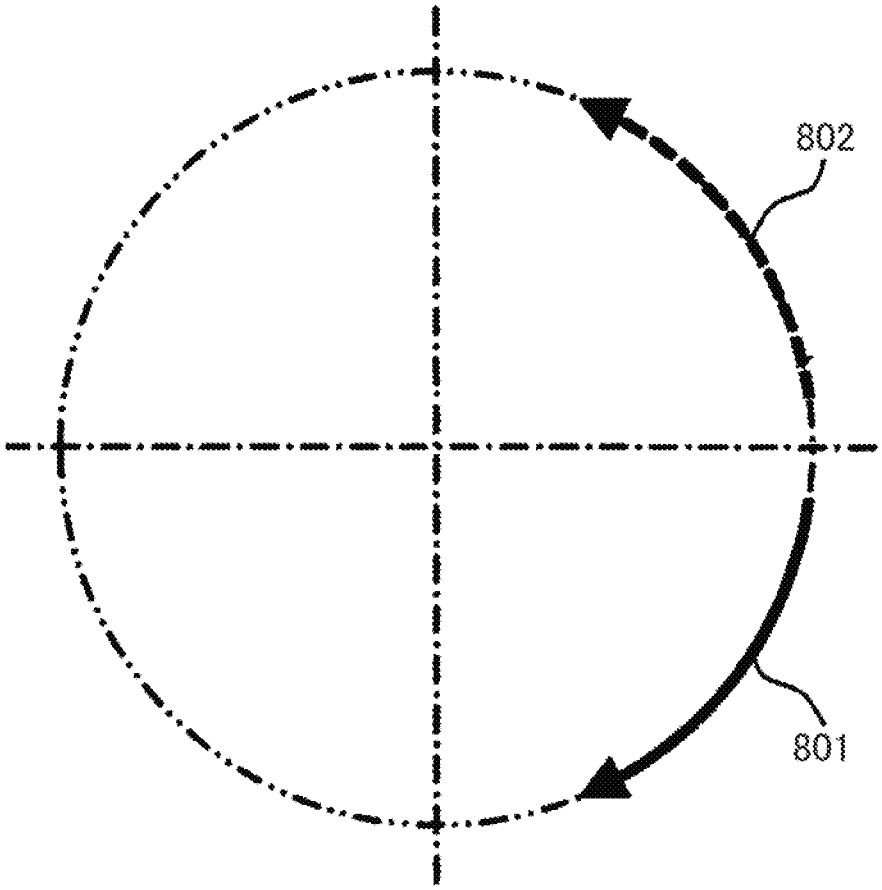
FIG. 12 is a planar schematic view for showing a coil winding direction.
Figure 13:
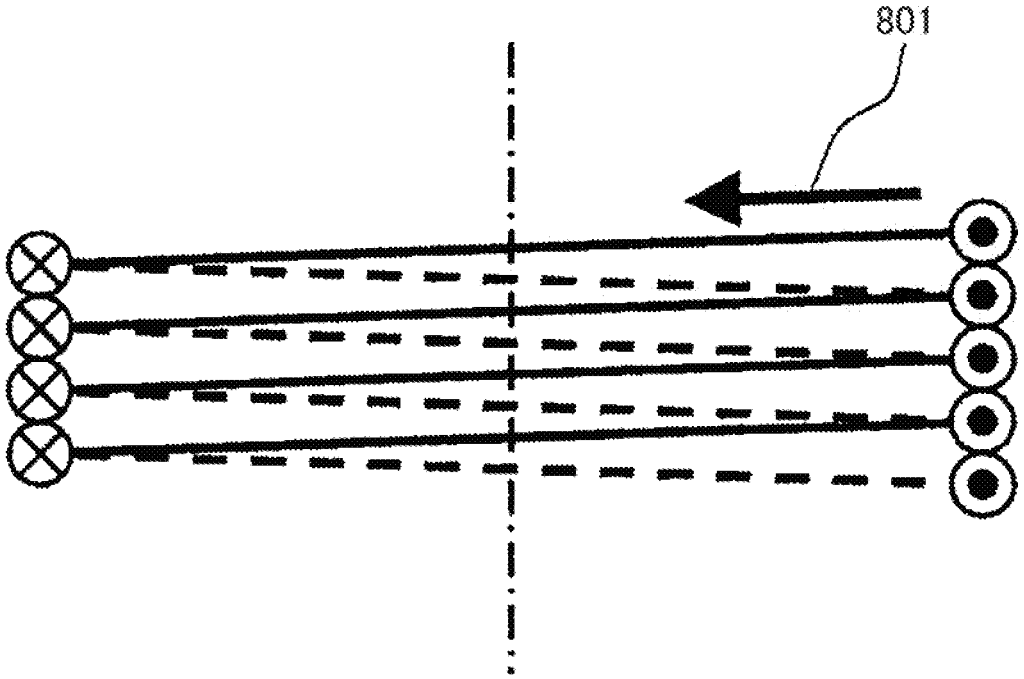
FIG. 13 is a side schematic view for showing a coil winding direction.
Figure 14:
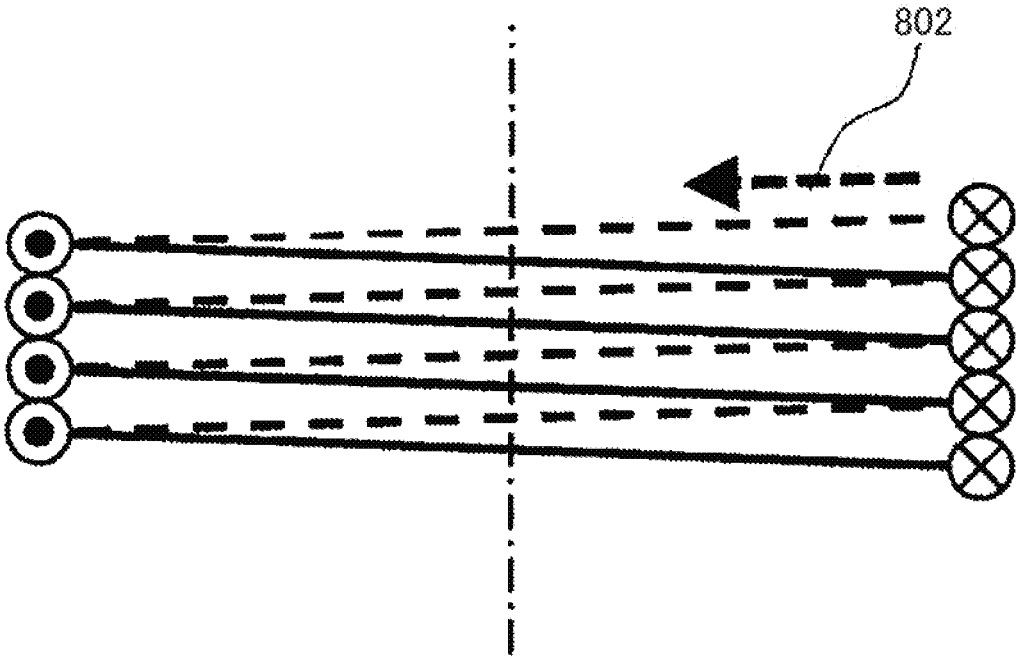
FIG. 14 is another side schematic view for showing a coil winding direction.

FIG. 1 to FIG. 4 are a front view, a planar cross-sectional view, a side cross-sectional view, and a side cross-sectional schematic view of a stationary induction electric apparatus in the embodiment, respectively. FIG. 9 and FIG. 10 are potential distribution diagrams in the vertical direction and the radial direction in the stationary induction electric apparatus of the embodiment, respectively. FIG. 12 to FIG. 14 are a planar schematic view, a side schematic view, and another side schematic view, respectively, for showing coil winding directions in the specification.

Figure 1:
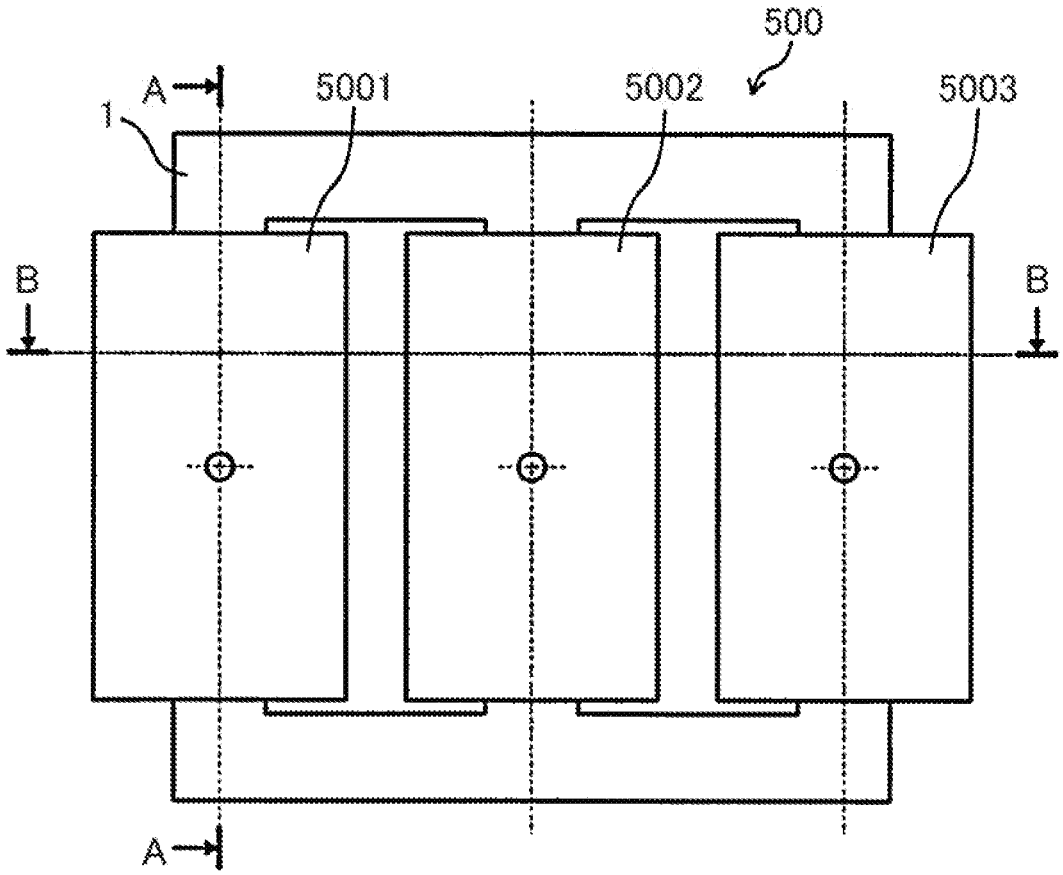
FIG. 1 is a front view of a stationary induction electric apparatus in a first embodiment.
Figure 2:
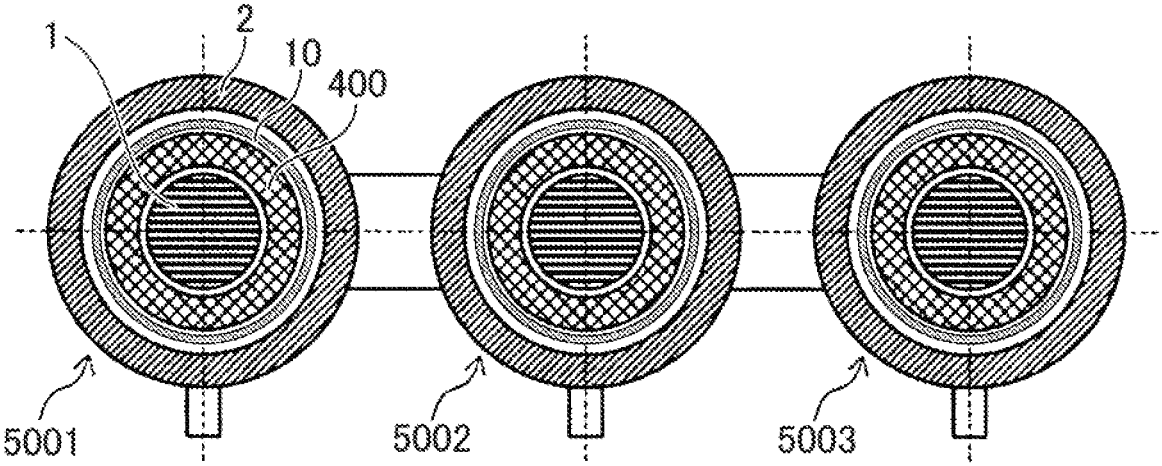
FIG. 2 is a planar cross-sectional view of the stationary induction electric apparatus in the first embodiment.

A stationary induction electric apparatus 500 shown in FIG. 1 and FIG. 2 is a three-phase transformer for electric power, and coil units 5001, 5002, and 5003 are wound around respective legs of a three-phase three-leg iron core 1. In the case where, for example, insulating oil and a sulfur hexafluoride gas are used instead of the air as fluid insulators for cooling the iron core and the coil units, these are stored inside a tank (not shown).

Next, a configuration of the coil unit 5001 in the embodiment will be described in detail using FIGS. 2 to 4. It should be noted that the coil units 5002 and 5003 are also configured in the same manner as the coil unit 5001.

Figure 3:
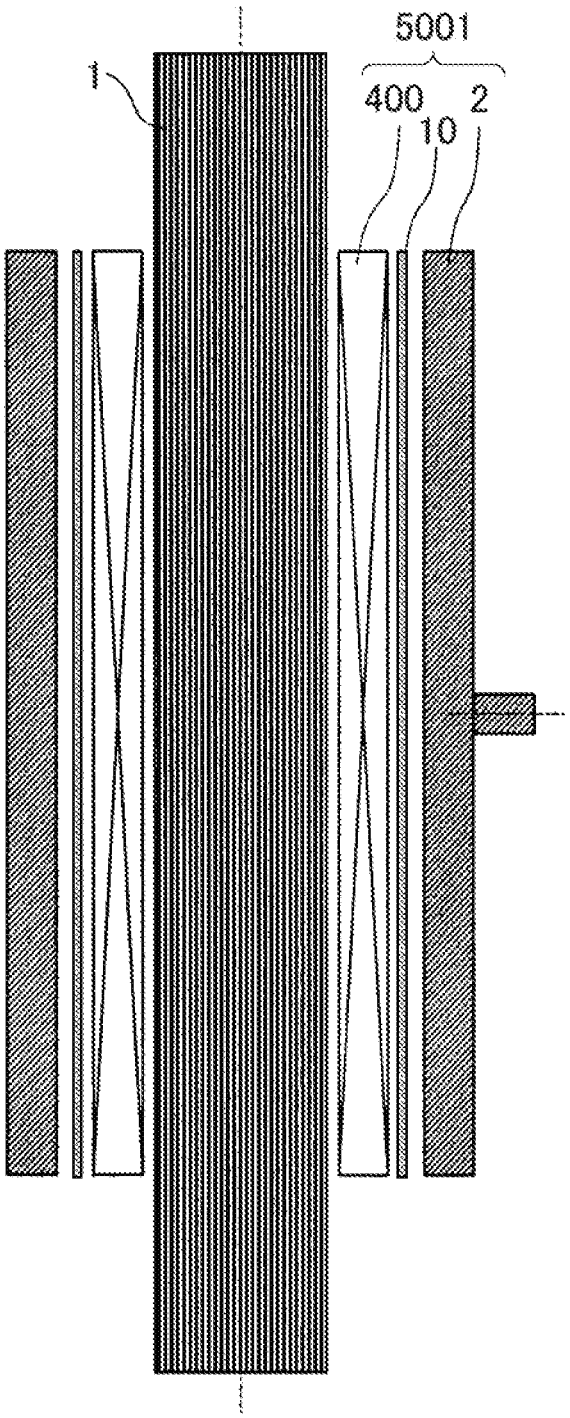
FIG. 3 is a side cross-sectional view of the stationary induction electric apparatus in the first embodiment.

As shown in FIG. 3, the coil unit 5001 in the embodiment is configured using a low-voltage coil 400 wound around the iron core, a shield unit 10 configured in a shape to enclose the outer periphery of the low-voltage coil, and a high-voltage coil 2 wound on the outer periphery of the shield unit. As shown in FIG. 4, the high-voltage coil 2 is divided into upper and lower parts 2*b* and 2*a* so as to become a mirror image at a central cross section in the vertical direction. Each part is shaped in such a manner that disk coils are piled up by an even number of stages in the vertical direction. In the case of the disk coils in the uppermost stage of the upper part 2*b*, four turns are wound in the order of turns 2001*b*, 2002*b*, 2003*b*, and 2004*b* from the outer side towards the inner side in a clockwise manner when viewed from the upper direction starting from the turn 2001*b* grounded at the outermost periphery. Then, after moving from the turn 2004*b* to the lower stage, four turns are wound from the inner side towards the outer side in a clockwise manner when viewed from the upper direction. Thereafter, to the lower stage, the turns are wound in the same manner, and the disk coils are piled up by an even number of stages to configure the upper part 2*b*.

In the case of the lowermost stage, four turns are wound in the order of turns 2397*b*, 2398*b*, 2399*b*, and 2400*b* from the inner side towards the outer side in a clockwise manner when viewed from the upper direction, and are electrically connected to an external voltage application end 100. In addition, 400 turns in total are wound to configure the upper part 2*b* in the embodiment. The lower part 2*a* is configured to become a mirror image of the upper part 2*b* at the central cross section. Thus, in the case of the disk coils in the uppermost stage, four turns are wound in the order of turns 2400*a*, 2399*a*, 2398*a*, and 2397*a* from the outer side towards the inner side in a counterclockwise manner when viewed from the upper direction starting from the turn 2400*a* at the outermost periphery electrically connected to the external voltage application end 100. In the case of the lowermost stage, four turns are wound in the order of turns 2004*a*, 2003*a*, 2002*a*, and 2001*a* from the inner side towards the outer side in a counterclockwise manner when viewed from the upper direction, and the turn 2001*a* is grounded.

Figure 4:
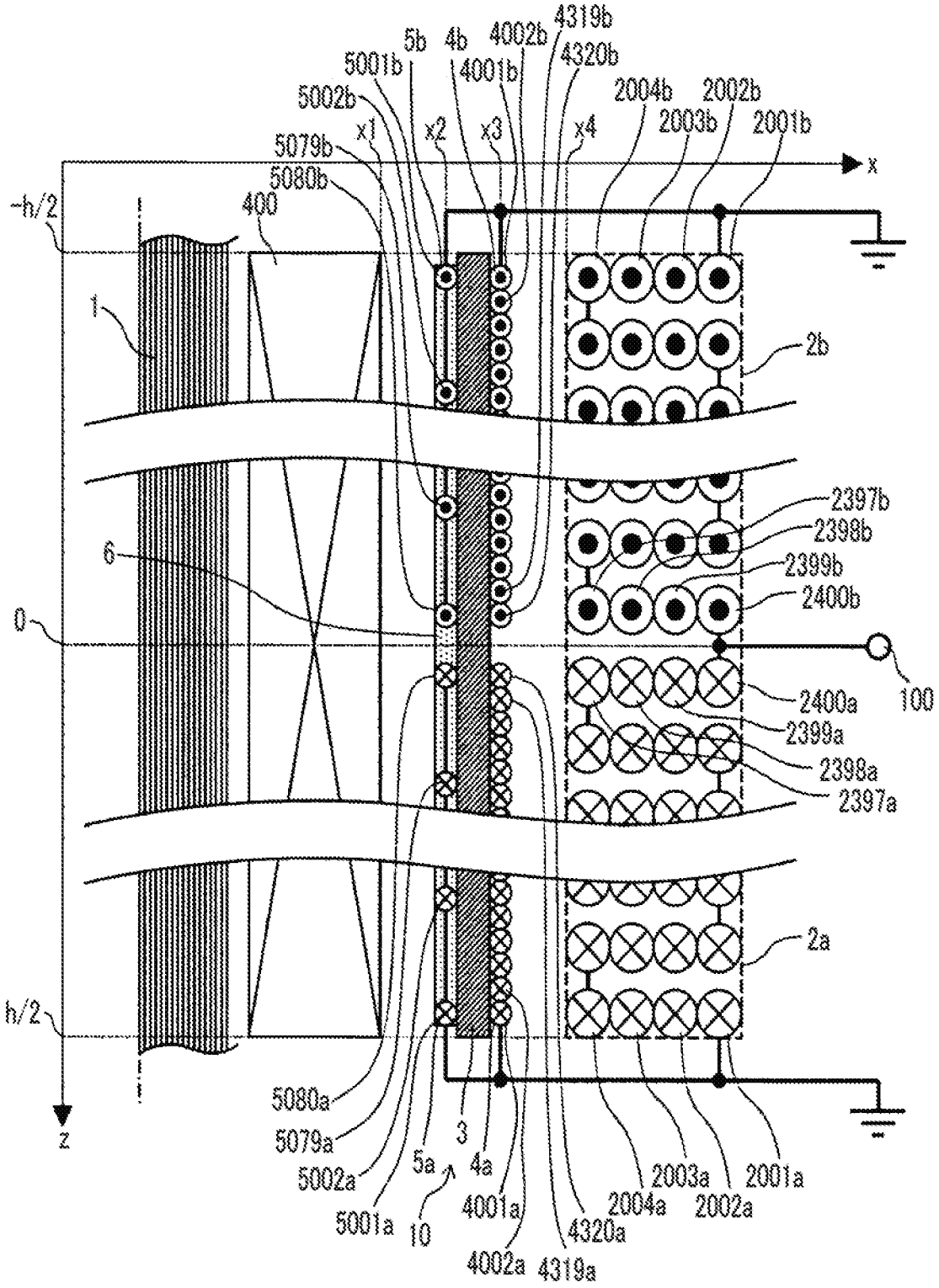
FIG. 4 is a side cross-sectional schematic view of the stationary induction electric apparatus in the first embodiment.

As shown in FIG. 4, the shield unit 10 is provided between the low-voltage coil 400 and the high-voltage coil 2, and is configured using an insulator 3 enclosing the iron core 1, shield conductors 4*a* and 4*b* wound adjacent to the outer periphery of the insulator, and shield conductors 5*a* and 5*b* wound adjacent to the inner periphery of the insulator.

In the shield conductor 4*a*, 320 turns in total are wound from the upper side towards the lower side ranging from the uppermost turn 4001*b* to the lowermost turn 4320*b* in a clockwise manner when viewed from the upper direction. In addition, the uppermost turn 4001*b* is grounded, and the lowermost turn 4320*b* is opened. The shield conductor 4*a* is configured to become a mirror image of the shield conductor 4*b* at the central cross section in the vertical direction. The uppermost turn 4320*a* is opened, and the lowermost turn 4001*a* is grounded. As similar to the above, in each of the shield conductors 5*a* and 5*b*, 80 turns in total are wound, and the shield conductors 5*a* and 5*b* become a mirror image at the central cross section in the vertical direction. It should be noted that a semiconductive material 6 is arranged around the shield conductors 5*a* and 5*b*, and has a function of moderating the potential distribution between the turns that are relatively separated from each other.

FIG. 12 to FIG. 14 are diagrams each showing the winding of the above-described coil together with a first winding direction 801 and a second winding direction 802.

Next, an operation of the stationary induction electric apparatus of the embodiment will be described using FIG. 9 and FIG. 10.

When an alternating voltage having a commercial frequency of 50 Hz or 60 Hz is applied to the external voltage application end 100 shown in FIG. 4, an alternating excitation current in accordance with the magnitude of the voltage flows symmetrically in the vertical direction to high-voltage coils 2*a* and 2*b*. The iron core 1 is excited by alternating magnetic fields in the same direction because the winding directions are opposite to each other. In addition, the alternating magnetic fields generate induced electromotive force at both ends of the shield conductors 4*a* and 4*b* and the shield conductors 5*a* and 5*b*. The magnitude thereof is roughly equal to a value obtained by multiplying a ratio of the number of turns of each shield conductor to the number of turns of the high-voltage coil by the input voltage. Thus, since each coil is configured as described above, the potential distribution formed in an area between the low-voltage coil and the high-voltage coil is shown in FIG. 9 and FIG. 10.

As shown in FIG. 10, the insulator is burdened with a high electric field by steeply changing the potential in the horizontal direction of the vertical central coordinate position z=0 in the insulator (between x2 and x3), and the electric field is reduced in an area of a fluid insulator located inside or outside the insulator. The insulating performance in the horizontal direction can be improved because the solid insulator that is higher in permittivity and insulating resistance than the fluid insulator can be burdened with a high electric field as described above.

On the other hand, a potential part in which the potential distribution in the vertical direction is high in the middle and is gently reduced towards the ends up to the ground potential is realized. In general, the creepage surface of the insulator becomes a weak point in insulation. However, the insulation can be easily kept by making the potential gradient (electric field) gentle as in the embodiment. In addition, the upper and lower ends serve as the ground potential, and it is not necessary to consider the insulation between the upper and lower ends and the iron core.

According to the embodiment, it is possible to provide a stationary induction electric apparatus that can improve the insulating performance with a few additional structures.

Second Embodiment

A second embodiment will be described using FIG. 5 to FIG. 8 and FIG. 11.

Figure 5:
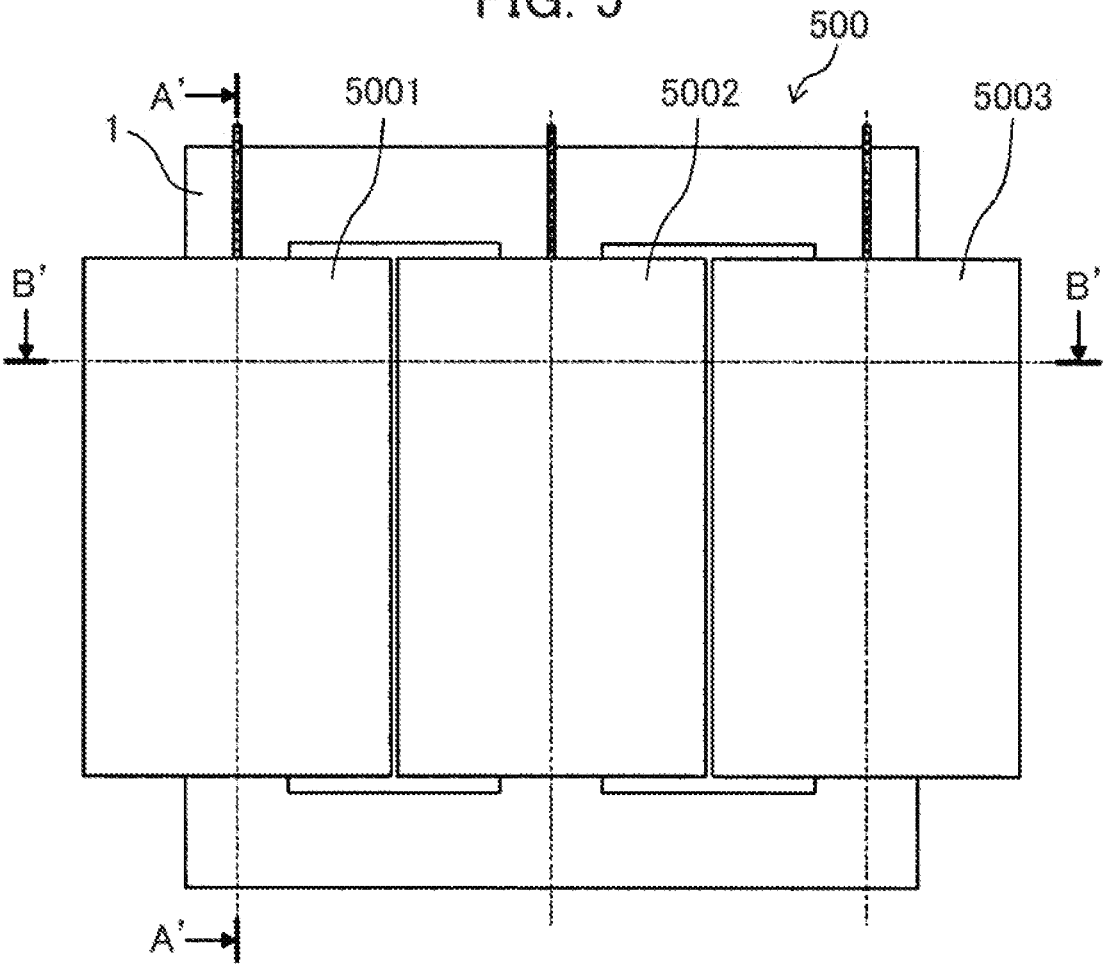
FIG. 5 is a front view of a stationary induction electric apparatus in a second embodiment.
Figure 6:
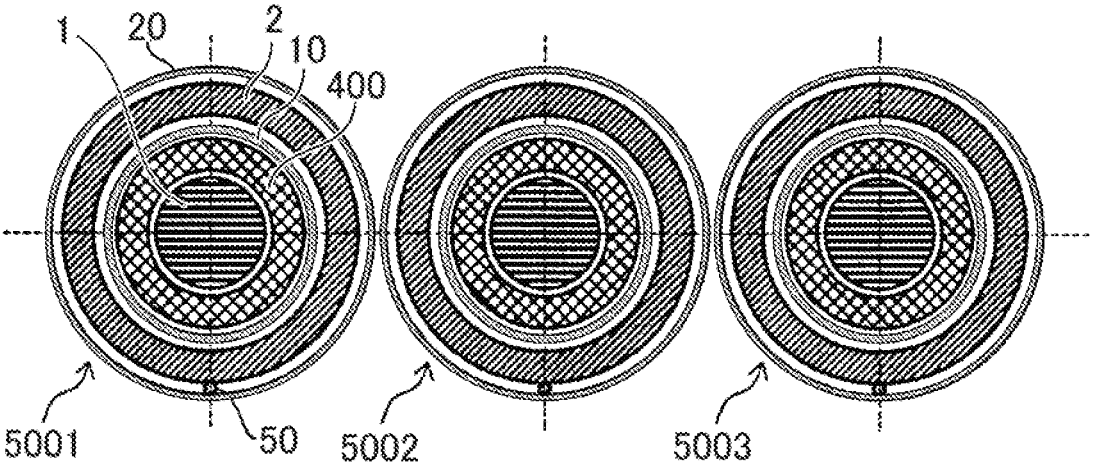
FIG. 6 is a planar cross-sectional view of the stationary induction electric apparatus in the second embodiment.
Figure 7:
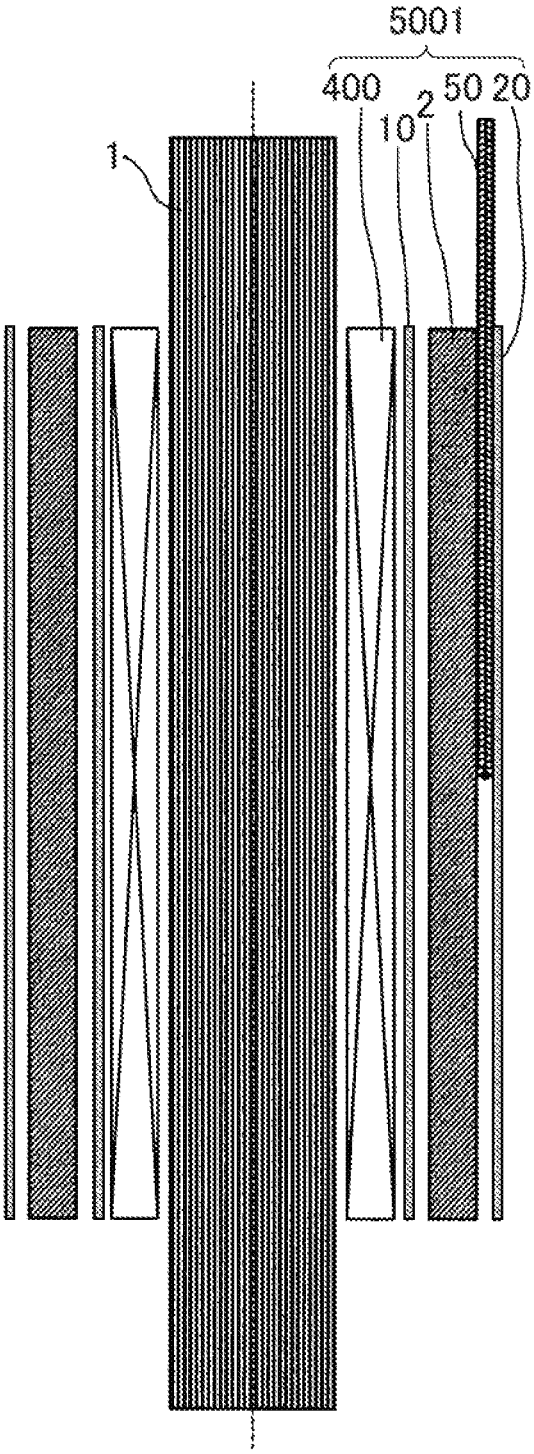
FIG. 7 is a side cross-sectional view of the stationary induction electric apparatus in the second embodiment.
Figure 8:
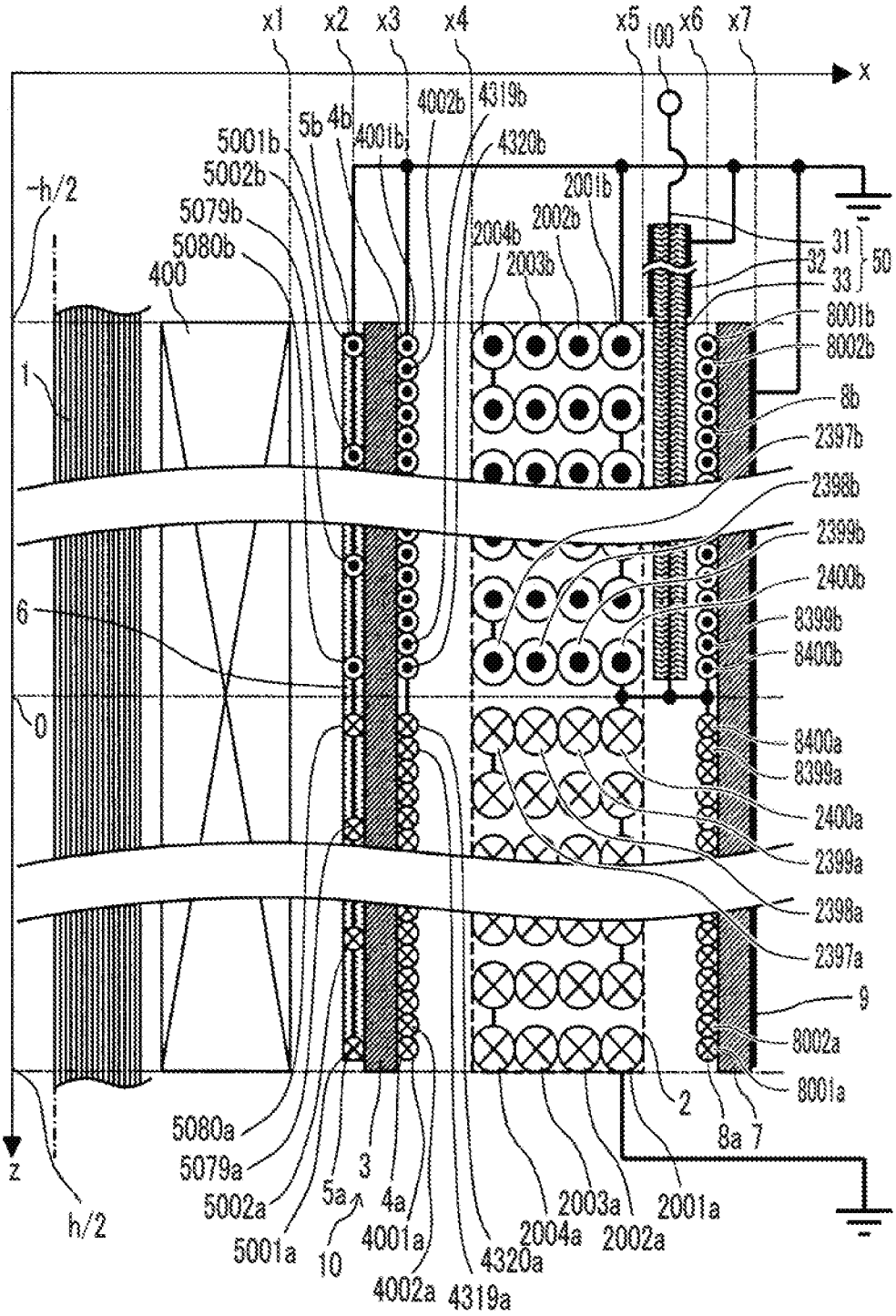
FIG. 8 is a side cross-sectional schematic view of the stationary induction electric apparatus in the second embodiment.
Figure 11:
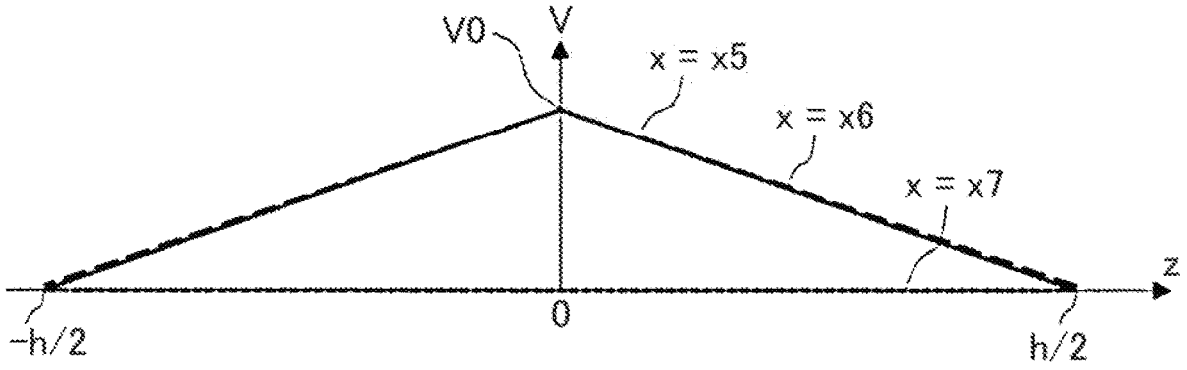
FIG. 11 is a potential distribution diagram in the vertical direction in the second embodiment.

FIG. 5 to FIG. 8 are a front view, a planar cross-sectional view, a side cross-sectional view, and a side cross-sectional schematic view of a stationary induction electric apparatus in the embodiment, respectively. FIG. 11 is a potential distribution diagram in the vertical direction in the stationary induction electric apparatus of the embodiment. As shown in FIGS. 6 to 8, the embodiment is different from the configuration of the first embodiment in that a shield unit 20 is arranged at the outer periphery of the high-voltage coil 2, a cable 50 is arranged between the high-voltage coil 2 and the shield unit 20, and the connection method of the shield conductors 4*a*, 4*b*, 5*a*, and 5*b* configuring the shield unit 10 is changed.

In the embodiment, the shield unit 20 is configured using an insulator 7, shield conductors 8*a* and 8*b* wound adjacent to the inner peripheral side of the insulator 7, and an electrostatic shield 9 arranged adjacent to the outer peripheral side of the insulator 7. The electrostatic shield 9 is divided in the circumferential direction to suppress an eddy current when an alternating voltage is applied. The total number of turns of the shield conductors 8*a* and 8*b* is 400 turns same as the high-voltage coils 2*a* and 2*b*.

The potential distribution in the vertical direction near the high-voltage coil and the shield unit 20 is shown as in FIG. 11 by employing the above-described configuration. The potential at the outermost periphery of each of the coil units 5001, 5002, and 5003 can be the ground potential by employing the configuration of the embodiment, and thus the dimension between the coil units can be shortened as shown in FIG. 5 and FIG. 6.

In addition, an external voltage is applied to the high-voltage coil using the cable 50 passing between the high-voltage coil 2 and the shield unit 20. Thus, in the case where a shield 32 covering the outermost periphery of the cable 50 is peeled off and a remaining insulator 33 is inserted from the upper direction to the lower direction, the electric field on the creepage surface of the insulator can be reduced, and there is an effect that a special insulation reinforcement process is not needed.

Although the connection method of the shield conductors 4*a*, 4*b*, 5*a*, and 5*b* configuring the shield unit 10 is changed, the potential distribution is not largely different from those shown in FIG. 9 and FIG. 10.

In addition to the effect of the first embodiment, the potential at the outermost periphery of each of the coil units 5001, 5002, and 5003 can be the ground potential and the dimension between the coil units can be shortened in the embodiment.

The present invention is not limited to the above-described embodiments, and includes various modified examples. For example, the above-described embodiments have been described in detail to easily understand the present invention, and are not necessarily limited to those including all the above-described configurations. In addition, some configurations of each embodiment can be added to, deleted from, or replaced by other configuration.

LIST OF REFERENCE SIGNS

1: iron core
2: high-voltage coil
3, 7, 33: insulator
4*a*, 4*b*, 5*a*, 5*b*, 8*a*, 8*b*: shield conductor
6: semiconductive material
9: electrostatic shield
10, 20: shield unit
32: shield
50: cable
100: external voltage application end
400: low-voltage coil
500: stationary induction electric apparatus
5001, 5002, 5003: coil unit

The invention claimed is:

1. A stationary induction electric apparatus comprising:
an iron core;
an insulator enclosing the iron core; and
a coil conductor which is wound on the insulator and to which a voltage is applied from the outside,
wherein a shield conductor is wound adjacent to the inner peripheral surface or the outer peripheral surface of the insulator, and one end of the shield conductor is electrically connected to any region of the coil conductor;
a low-voltage coil conductor wound on the iron core;
an insulator enclosing the low-voltage coil conductor;
a high-voltage coil conductor which is wound on the insulator and to which a voltage is applied from the outside;
wherein a first shield conductor wound adjacent to the inner peripheral surface of the insulator and a second shield conductor wound adjacent to the outer peripheral surface of the insulator, and one end of the first shield conductor and one end of the second shield conductor are electrically connected to any region of the high-voltage coil conductor;
wherein the number of turns of the second shield conductor is larger than that of the first shield conductor; and
wherein a semiconductive material is arranged around the first shield conductor.

2. The stationary induction electric apparatus according to claim 1,
wherein the first shield conductor and the second shield conductor become a mirror image at the cross section perpendicular to the axis direction of the iron core in the middle of the vertical direction.

3. The stationary induction electric apparatus according to claim 2, comprising:
a third shield conductor wound on the high-voltage coil conductor;
a second insulator enclosing the third shield conductor; and
an electrostatic shield enclosing the second insulator.

4. The stationary induction electric apparatus according to claim 3,
wherein a voltage is applied from the outside using a cable passing between the high-voltage coil conductor and the third shield conductor.

5. The stationary induction electric apparatus according to claim 4,
wherein a shield covering the outermost periphery of the cable is peeled off from the cable arranged in a space sandwiched between the high-voltage coil conductor and the third shield conductor.

6. The stationary induction electric apparatus according to claim 5,
wherein the other end of the third shield conductor is electrically connected to any region of the high-voltage coil conductor.

7. The stationary induction electric apparatus according to claim 6,
wherein the number of turns of the third shield conductor is equal to that of the high-voltage coil conductor.

* * * * *